US009879367B2

(12) United States Patent
Osanai et al.

(10) Patent No.: US 9,879,367 B2
(45) Date of Patent: Jan. 30, 2018

(54) SEWING MACHINE EQUIPPED WITH NEEDLE THREADING DEVICE

(71) Applicant: JANOME SEWING MACHINE Co., Ltd., Tokyo (JP)

(72) Inventors: Yasuhiro Osanai, Tokyo (JP); Masatoshi Takeuchi, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 441 days.

(21) Appl. No.: 14/497,132

(22) Filed: Sep. 25, 2014

(65) Prior Publication Data

US 2015/0259840 A1 Sep. 17, 2015

(30) Foreign Application Priority Data

Mar. 11, 2014 (JP) ..... 2014-048241

(51) Int. Cl.
*D05B 87/00* (2006.01)
*D05B 87/02* (2006.01)

(52) U.S. Cl.
CPC ..... *D05B 87/02* (2013.01)

(58) Field of Classification Search
CPC ..... D05B 87/02; D05B 87/00; D05B 87/04
USPC ..... 112/224–225
See application file for complete search history.

(56) References Cited

U.S. PATENT DOCUMENTS 5,003,899 A 4/1991 Ogawa
5,003,900 A * 4/1991 Ogawa ..... D05B 87/02 112/225
5,086,719 A 2/1992 Ogawa
5,090,345 A * 2/1992 Ogawa ..... D05B 87/02 112/221
5,092,257 A 3/1992 Ogawa
5,097,775 A 3/1992 Ogawa et al.
5,596,940 A * 1/1997 Yamada ..... D05B 87/02 112/225
5,615,629 A 4/1997 Yamada et al.
6,067,919 A * 5/2000 Shoji ..... D05B 87/02 112/225

(Continued)

FOREIGN PATENT DOCUMENTS

JP 08-173676 A 7/1996

OTHER PUBLICATIONS

United States Notice of Allowance dated Apr. 19, 2017 in co-pending U.S. Appl. No. 15/374,666.

*Primary Examiner* — Nathan Durham
(74) *Attorney, Agent, or Firm* — McGinn IP Law Group, PLLC

(57) ABSTRACT

In a sewing machine equipped with a needle threading device, a thread holding tool includes: a thread holding surface part that guides and holds a thread; a thread pressing member that presses and sandwiches together with the thread holding surface part the thread; and a thread detachment preventing part that is provided to cross the thread which is sandwiched between the thread pressing member and the thread holding surface part. When passing the thread through the needle hole, a thread detachment preventing part regulates the thread so that the thread, which is sandwiched between the thread holding surface part and the thread pressing member of the thread holding tool, passes in a predetermined direction without deviating from a thread holding state.

12 Claims, 8 Drawing Sheets

ENLARGED PART β

(56) References Cited

U.S. PATENT DOCUMENTS

| | | | | |
|---|---|---|---|---|
| 6,742,466 | B2 * | 6/2004 | Sano | D05B 65/00 112/225 |
| 9,212,439 | B2 * | 12/2015 | Suzuki | D05B 87/02 |
| 2002/0073904 | A1 * | 6/2002 | Sano | D05B 87/02 112/302 |
| 2002/0195037 | A1 * | 12/2002 | Kotaki | D05B 87/02 112/302 |
| 2003/0019410 | A1 | 1/2003 | Sano et al. | |
| 2005/0022709 | A1 * | 2/2005 | Yoshikazu | D05B 87/02 112/225 |
| 2005/0115479 | A1 * | 6/2005 | Ebata | D05B 87/02 112/225 |
| 2006/0011117 | A1 * | 1/2006 | Shoji | D05B 49/00 112/225 |
| 2006/0118017 | A1 | 6/2006 | Watanabe et al. | |
| 2006/0278146 | A1 | 12/2006 | Shiraishi | |
| 2007/0017424 | A1 | 1/2007 | Fluckiger et al. | |
| 2009/0013912 | A1 | 1/2009 | Miyoshi | |
| 2009/0064914 | A1 | 3/2009 | Miyoshi | |
| 2009/0183663 | A1 | 7/2009 | Fujihara | |
| 2010/0071603 | A1 * | 3/2010 | Miyoshi | D05B 87/02 112/225 |

* cited by examiner

Fig. 1A
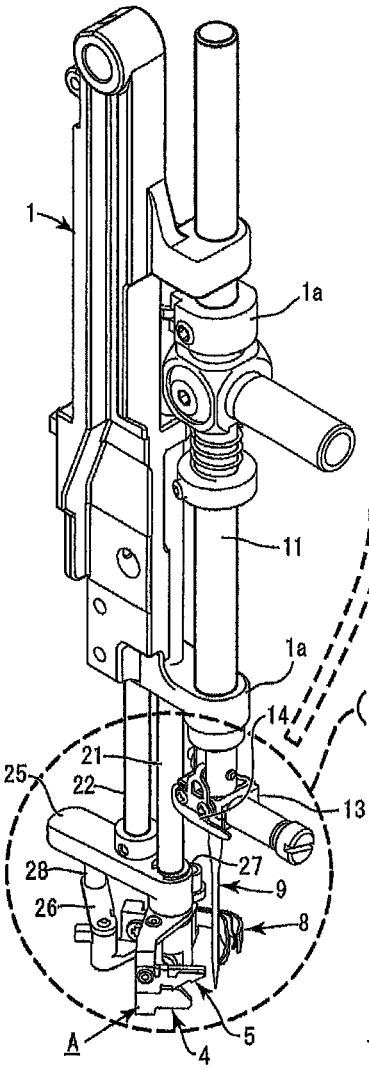
Fig. 1B
ENLARGED PART α
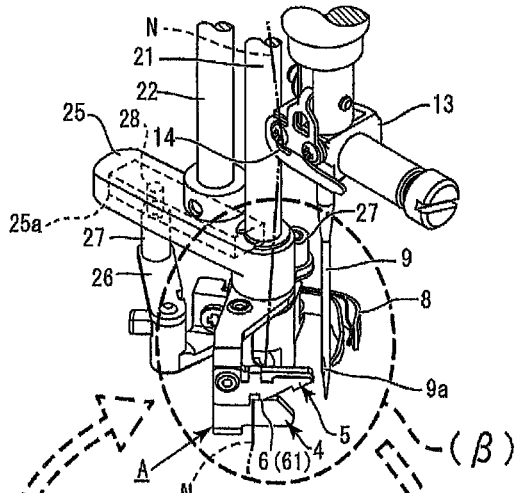
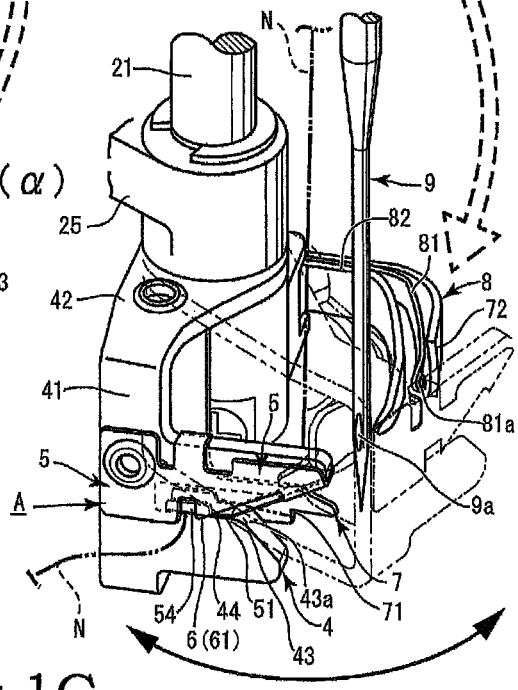
Fig. 1C
ENLARGED PART β

Fig.2B
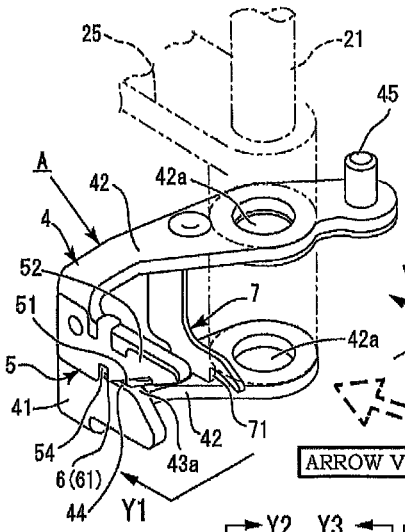
Fig.2A
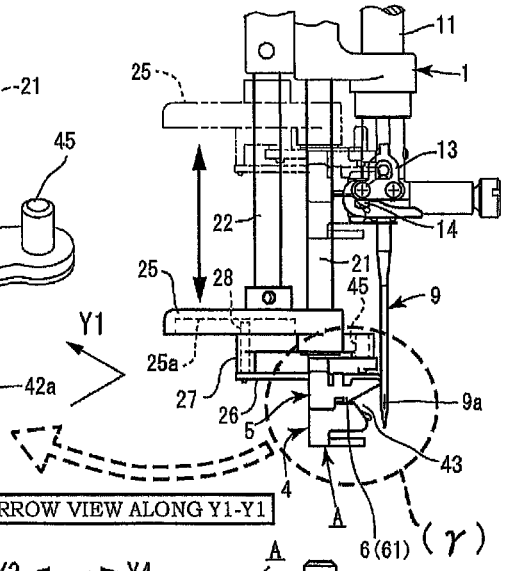
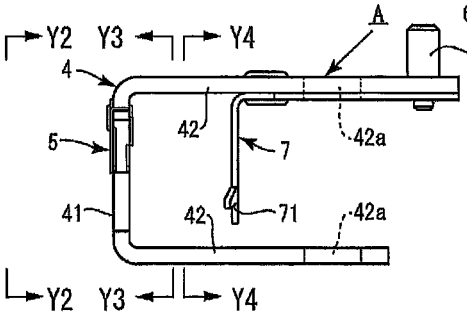
Fig.2C
ARROW VIEW ALONG Y2-Y2
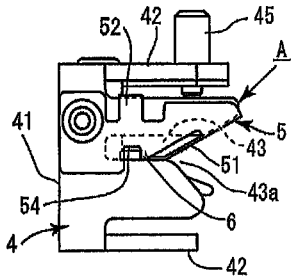
Fig.2D
ARROW VIEW ALONG Y3-Y3
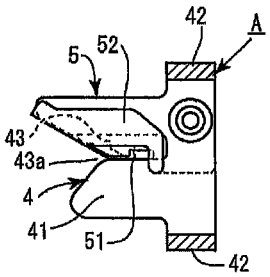
Fig.2E
ARROW VIEW ALONG Y4-Y4
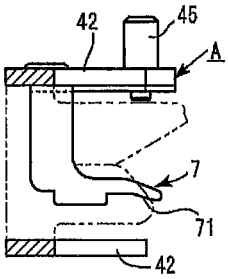
Fig.2F Fig.3A
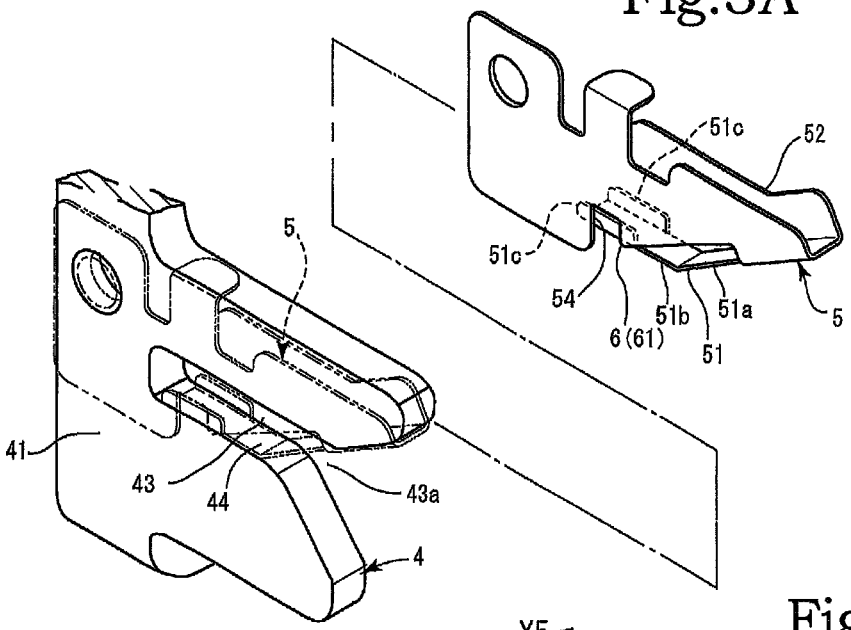
Fig.3C
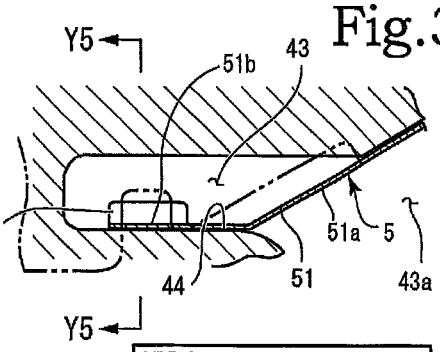
Fig.3B
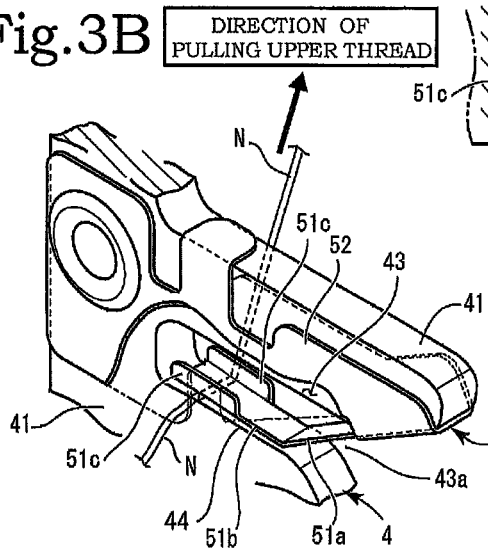
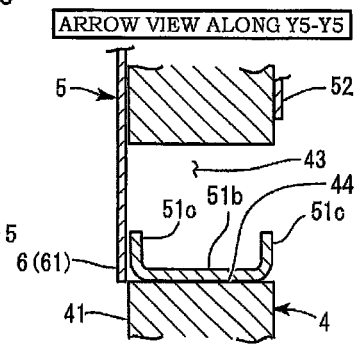
Fig.3D

ARROW VIEW ALONG Y7-Y7

ARROW VIEW ALONG Y8-Y8

ARROW VIEW ALONG Y9-Y9

Fig.7A
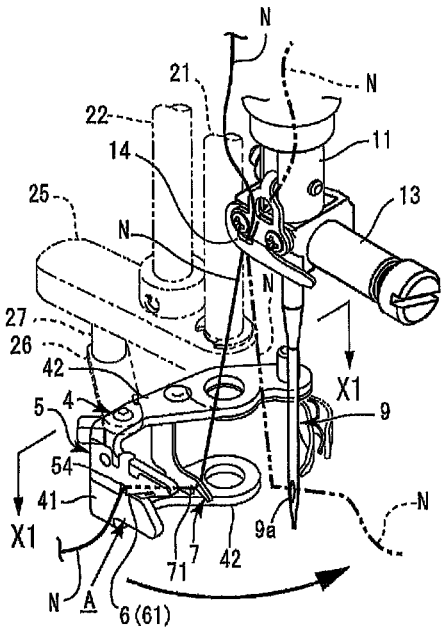
Fig.7B
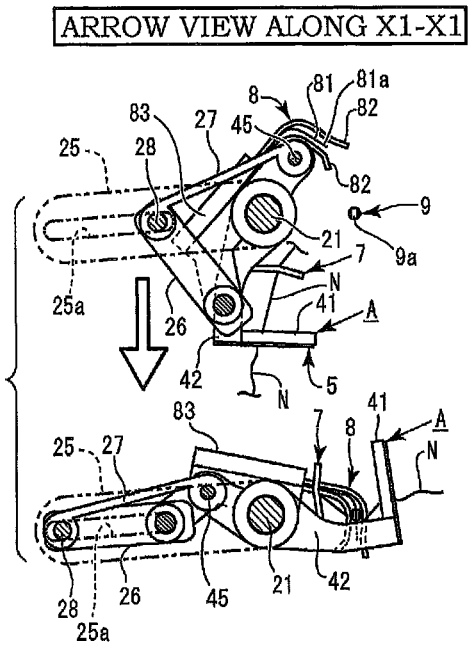
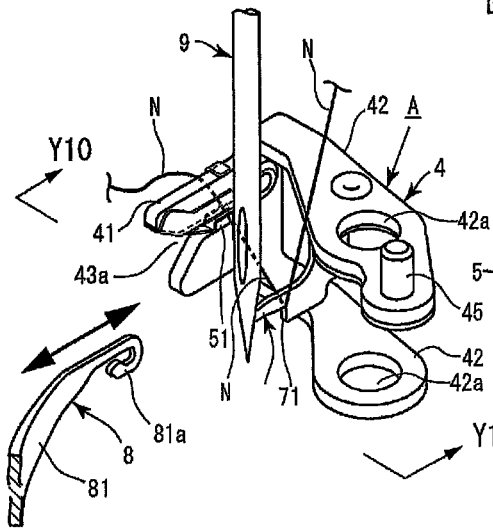
Fig.7C
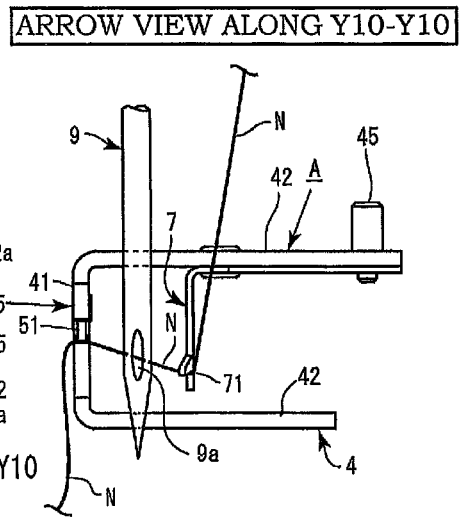
Fig.7D

SEWING MACHINE EQUIPPED WITH NEEDLE THREADING DEVICE

BACKGROUND OF THE INVENTION

1. Field of the Invention

The present invention relates to a sewing machine equipped with a needle threading device which includes a mechanism for giving a tension to a thread of the sewing machine in order to securely insert the thread through a needle hole.

2. Description of the Related Art

Conventionally, there have been proposed various needle threading devices, in order to pass a thread through a sewing needle of a sewing machine. A needle threading device disclosed in Japanese Patent Application Laid-open No. H8-173676 has a needle threading hook at the front end of which there is formed a hooking part that catches a thread. The needle threading device performs a needle threading operation in such a way that the needle threading hook catches the thread that is stretched by a thread holding tool in a state that the thread is tensioned near the needle hole of the string, and the needle threading hook is pulled out from the needle hole.

In the needle threading device, the needle threading hook that has been pulled out from the needle hole is moved upward from the needle hole, in order to more securely pull out the thread from the needle hole. In the upward movement, the thread is detached from a hook part of the hook, based on the frictional force in the needle hole and the weight of the thread itself, and the needle threading operation is completed.

SUMMARY OF THE INVENTION

However, in the needle threading device, in order for the hook that is reciprocated through the needle hole to securely catch the thread which is positioned at the opposite side of the hook centered around the needle, the thread must be in a tensioned state. When the thread is in a loosened state without maintaining the tension, the hook cannot catch the thread.

Accordingly, in order to enable the hook to catch the thread, there exist various devices that give a tensioned state to the thread. Japanese Patent Application Laid-open No. H8-173676 discloses a mechanism that gives tension to the thread in the needle threading operation. Specifically, the upper thread NT of which one end is held by the thread holding tool 7 is tensioned between the thread holding tool 7 and the thread locking part 5, as a distance between the thread holding tool 7 and the thread locking part 5 becomes large. At this time, based on the turning of the thread locking part 5, the thread hooking claw 63 slides to the thread supply source side while keeping the tension of the upper thread NT between the thread holding tool 7 and the thread locking part 5, and the thread hooking claw 63 attempts to absorb the loosening of the upper thread NT at the thread supply source side.

However, according to the thread tension mechanism disclosed in Japanese Patent Application Laid-open No. H8-173676, the mechanism is extremely complex, and component members are arranged extensively around the needle. The operation of giving tension to the thread is also extremely troublesome. Maintaining the tension of the thread is also unstable, and there is a sufficient risk of loosening the thread in the middle of the needle threading operation.

Further, increasing the holding force to tension the thread has a risk that the thread cannot be easily released from the tension mechanism even when the hook catches the thread and that a damage such as breakage of the hook occurs. Further, depending on the thread tension mechanism, there is also a risk that hangnail and fuzz occur in the thread every time the thread passes the end portion of each mechanism.

Accordingly, an object of the present invention is to provide a device having an extremely simple configuration that gives tension to a thread of a sewing machine in order to securely insert the thread into a needle hole of a sewing needle so that a tensioned thread is not easily loosened and that the thread after passing through the needle can be easily separated from the device.

In order to solve the above problems, as a result of intensive studies carried out by the inventor, there has been provided a sewing machine equipped with a needle threading device according to a first implementation mode of the present invention as follows. The sewing machine includes: a needle bar supporting frame body on which there is mounted a needle bar that is mounted with a needle having a needle hole; a needle threading shaft that is disposed on the needle bar supporting frame body and is supported vertically movably and also turnably in a peripheral direction; a thread pressing part and a thread holding tool that are provided at a lower end of the needle threading shaft and that hold in a tensioned state a thread opposite the needle hole; and a needle threading tool that is provided at a lower end of the needle threading shaft and that has a hook which reciprocates through the needle hole to pass the thread through the needle hole. The thread holding tool includes a thread holding surface part that guides and holds the thread, a thread pressing member that presses and sandwiches together with the thread holding surface part the thread, and a thread detachment preventing part that is provided to cross the thread which is sandwiched between the thread pressing member and the thread holding surface part. When passing the thread through the needle hole, the thread detachment preventing part regulates the thread so that the thread, which is sandwiched between the thread holding surface part and the thread pressing member of the thread holding tool, passes in a predetermined direction without deviating from a thread holding state. With this arrangement, the above problems have been solved.

A sewing machine equipped with a needle threading device according to a second implementation mode of the present invention is provided as follows. In the sewing machine equipped with a needle threading device according to the first implementation mode, the thread holding tool includes: a thread holding base member equipped with a thread holding plate that holds a thread which is fixed to the needle threading shaft; and a thread pressing member that is mounted on the thread holding base member and that holds the thread by pressing. The thread holding plate forms a holding groove part that has an end surface of a groove, of which one end is opened, as a thread holding surface part which holds the thread. The thread pressing member includes a spring plate part that sandwiches together with the thread holding surface part the thread by pressing, and also includes a projection piece for preventing thread detachment. The projection piece is provided to cross the thread that is held by pressing by the holding groove part of the thread holding plate.

A sewing machine equipped with a needle threading device according to a third implementation mode of the present invention is provided as follows. In the sewing machine equipped with a needle threading device according to the second implementation mode, the front end of the projection piece is at the same position as the position of the thread holding surface part. With this arrangement, the above problems have been solved. A sewing machine equipped with a needle threading device according to a fourth implementation mode of the present invention is provided as follows. In the sewing machine equipped with a needle threading device according to the second implementation mode, the front end of the projection piece is at a lower position than the position of the thread holding surface part. With this arrangement, the above problems have been solved. A sewing machine equipped with a needle threading device according to a fifth implementation mode of the present invention is provided as follows. In the sewing machine equipped with a needle threading device according to the second implementation mode, the front end of the projection piece is at a higher position than the position of the thread holding surface part. With this arrangement, the above problems have been solved.

A sewing machine equipped with a needle threading device according to a sixth implementation mode of the present invention is provided as follows. In the sewing machine equipped with a needle threading device according to the first implementation mode, the thread holding tool includes: a thread holding plate that is formed on a thread holding base member fixed to the needle threading shaft and that holds the thread; and a thread pressing member that is mounted on the thread holding plate and that holds the thread by pressing. The thread holding plate includes a holding groove part that is equipped with a protrusion part for preventing thread detachment on a thread holding surface part, by using an end surface of a groove, of which one end is opened, as the thread holding surface part. The thread pressing member includes a spring plate part that sandwiches together with the thread holding surface part the thread by pressing. The protrusion part is provided on the thread holding surface part so as to cross the thread which is pressed and held by the spring plate part and the thread holding surface part of the thread holding plate.

A sewing machine equipped with a needle threading device according to a seventh implementation mode of the present invention is provided as follows. In the sewing machine equipped with a needle threading device according to the first implementation mode, the thread holding tool includes: a thread holding base member equipped with a thread holding plate that holds a thread which is fixed to the needle threading shaft; and a thread pressing member that is mounted on the thread holding plate of the thread holding base member and that holds the thread by pressing. The thread holding plate includes a holding groove part that is equipped with a notched part for preventing thread detachment on a thread holding surface part, by using an end surface of a groove, of which one end is opened, as the thread holding surface part. The thread pressing member includes a spring plate part that sandwiches together with the thread holding surface part the thread by pressing. The notched part of the thread holding surface part is provided to cross the thread that is held by pressing by the spring plate part and the thread holding surface part of the thread holding plate.

A sewing machine equipped with a needle threading device according to an eighth implementation mode of the present invention is provided as follows. In the sewing machine equipped with a needle threading device according to the first or second implementation mode, a rising piece is formed on at least one end in a width direction of a pressing plate part of the thread pressing member. With this arrangement, the above problems have been solved. A sewing machine equipped with a needle threading device according to a ninth implementation mode of the present invention is provided as follows. In the sewing machine equipped with a needle threading device according to the first or second implementation mode, a bottom part of a pressing plate part of the thread pressing member is formed in an arc shape. With this arrangement, the above problems have been solved.

In the present invention, the operation becomes extremely simple, by only inserting an upper thread into the holding groove part in order to give a tension to the upper thread. Also, the thread detachment preventing part can prevent the tensioned upper thread from being easily detached from the thread holding tool. After the needle threading operation is completed, the upper thread N can be easily detached from the thread holding tool. Further, when passing the thread through the needle hole, the thread detachment preventing part regulates the thread so that the thread sandwiched between the thread holding surface part and the thread pressing member of the thread holding tool is passed to a predetermined direction without deviating from a thread holding state. With this arrangement, at the needle threading time, a state that the upper thread is securely caught by the hook is maintained so that the needle threading is ensured. After the thread has been passed through the needle hole, the upper thread can be easily detached from the holding groove part, and work efficiency can be improved.

BRIEF DESCRIPTION OF THE DRAWINGS

FIG. 1A is a perspective view of a thread detachment preventing part having a first type of a pressing plate part of a sewing machine according to a first embodiment of the present invention, FIG. 1B is an enlarged view of a part α in FIG. 1A, and FIG. 1C is an enlarged view of a part β in FIG. 1B;

FIG. 2A is a side view of a main part of the thread detachment preventing part according to the present invention, FIG. 2B is an enlarged view of a part γ in FIG. 2A, FIG. 2C is an arrow view along Y1-Y1 in FIG. 2B, FIG. 2D is an arrow view along Y2-Y2 in FIG. 2C, FIG. 2E is a side sectional view along Y3-Y3 in FIG. 2C, and FIG. 2F is an arrow sectional view along Y4-Y4 in FIG. 2C;

FIG. 3A is a perspective view of a thread holding tool which is separated into a thread holding base member and a thread pressing member, FIG. 3B is a partially-disconnected perspective view of a main part of the thread holding tool, FIG. 3C is a sectional view of a main part of the thread holding base member, and FIG. 3D is an arrow enlarged sectional view along Y5-Y5 in FIG. 3C;

FIG. 7A is a perspective view of a main part showing a tension structure of the upper thread which is to be passed through by the thread holding tool according to the present invention, FIG. 7B is an arrow sectional view along X1-X1 in FIG. 7A and is also a process view showing operations of the thread holding tool and a needle threading tool in a needle threading process, FIG. 7C is a perspective view showing a state that a hook plate of the needle threading tool is about to be inserted into a needle hole while the upper thread is being tensioned at a rear surface side of the needle by the thread holding tool, and FIG. 7D is an arrow view along Y10-Y10 in FIG. 7C.

DESCRIPTION OF THE PREFERRED EMBODIMENTS

Figure 4B:
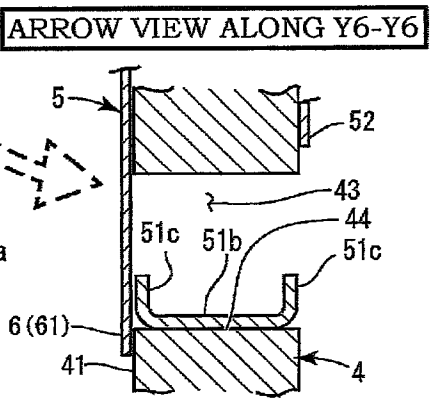
FIG. 4B is an arrow view along Y6-Y6 in FIG. 4A.

Hereinafter, embodiments of the present invention will be described with reference to the drawings. In the following description, a direction in which an operator is positioned relative to a sewing machine will be a front direction, and a left and right direction as observed from the operator will be a left and right direction. A side where an upper thread N is supplied will be an upper direction.

First, as shown in FIGS. 1A to 1C, a needle threading device according to the present invention is mainly configured by a needle bar supporting frame body 1, a needle bar 11, a needle threading shaft 21, a thread holding tool A, and a needle threading tool 8. The needle bar supporting frame body 1 is mounted on a sewing machine body not shown, and performs a vertical movement of a needle to form a seam and a sliding operation to the left and right. The needle bar supporting frame body 1 is mounted with the needle bar 11, the needle threading shaft 21, and a guide shaft 22.

In the needle bar supporting frame body 1, there are formed a plurality of shaft supporting parts 1*a* for supporting the needle bar 11, the needle threading shaft 21, and the guide shaft 22. The needle bar 11, the needle threading shaft 21, and the guide shaft 22 are supported to the needle bar supporting frame body 1 slidably in the vertical direction.

The needle bar supporting frame body 1 includes a motor driving unit not shown, and the needle threading shaft 21 and the guide shaft 22 are driven by the motor driving unit. A driving mechanism of the needle threading device is not limited to the motor driving unit, and may be other driving mechanism, or the needle threading device may be manually driven.

The needle bar supporting frame body 1 is mounted on a sewing machine frame not shown, and supports the needle bar 11 vertically movably and slidably in a direction orthogonal with a cloth feeding direction (left and right). One end of a spring is fitted to an upper side of the needle bar supporting frame body 1, and the other end of the spring is fitted to a lever of the needle threading shaft 21 so that the needle threading shaft 21 and the guide shaft 22 are always elastically biased upward. The needle bar 11 is a bar-shaped member that has a needle 9 fitted to a front end part of the member.

The needle bar 11 includes a needle stopper 13. The needle stopper 13 is a member for holding the needle 9 by fixing the needle 9 to the needle bar 11, and is provided at a front end (lower end) portion of the needle bar 11. By the needle stopper 13, the needle 9 is fixed to the needle bar 11 with a screw so that a needle hole 9*a* faces a sewing direction (a front and rear direction) of the sewing machine. A thread hooking part 14 is provided in the needle stopper 13. The thread hooking part 14 is a portion where the upper thread N which is fed from a thread hook as a supply source of the upper thread N passes while being locked.

The thread holding tool A and the needle threading tool 8 are fitted to a lower end of the needle threading shaft 21. The needle threading shaft 21 is equipped with regulating means that regulates fall positions of the thread holding tool A and the needle threading tool 8. When the thread holding tool A and the needle threading tool 8 reach the needle hole 9*a* of the needle 9 by the regulating means, the fall of the thread holding tool A and the needle threading tool 8 is stopped together with the needle threading shaft 21 (see FIG. 2A). Next, the thread holding tool A and the needle threading tool 8 are turned in a peripheral direction of the needle threading shaft 21.

The needle threading shaft 21 is a member on which the thread holding tool A and the needle threading tool 8 are mounted, as described above, and which vertically moves and turns the thread holding tool A and the needle threading tool 8. Then, the needle threading shaft 21 vertically moves the thread holding tool A and the needle threading tool 8 within a range from a height (a waiting position) near the needle stopper 13 to a position (a needle threading position) where the thread can be passed through the needle hole 9*a* of the needle 9 (see FIG. 2A).

The guide shaft 22 is a member that turns, together with the needle threading shaft 21, the thread holding tool A and the needle threading tool 8 described later in mutually different directions. The guide shaft 22 moves, together with the needle threading shaft 21, in a vertical direction within the same range relative to the needle bar supporting frame body 1 (see FIG. 2A).

A guide member 25 having a guide groove 25*a* is fitted to a lower surface, at a lower end of the guide shaft 22. The needle threading shaft 21 is turnably inserted into one end in a longitudinal direction of the guide member 25. The guide member 25 is unmovable in a horizontal direction. That is, a direction of the longitudinal direction is determined to the guide member 25. A first link member 26 and a second link member 27 are coupled to the guide member 25 (see FIGS. 1A and 1B, and FIG. 7B).

The guide member 25, the first link member 26, and the second link member 27 are members that turn the thread holding tool A and the needle threading tool 8 in mutually reverse (opposite) directions centered around the needle threading shaft 21 (see FIG. 7B). A guide pin 28 is formed to face upward, on one end in the longitudinal direction of the second link member 27.

The guide pin 28 is pivotally coupled to one end position in the longitudinal direction of the first link member 26. Specifically, the guide pin 28 is pivotally coupled so as to pierce through a pivot hole which is formed on one end in the longitudinal direction of the first link member 26 (see FIG. 7B). The guide pin 28 is then, without any modification, inserted into the guide groove 25*a* of the guide member 25. The guide pin 28 is slidably inserted in a horizontal direction, and one ends in the longitudinal directions of the first link member 26 and the second link member 27 can reciprocally move along the guide groove 25*a*.

The thread holding tool A is coupled to the other end in the longitudinal direction of the first link member 26. The needle threading tool 8 is coupled to the other end in the longitudinal direction of the second link member 27. The thread holding tool A is formed of a thread holding base member 4, a thread pressing member 5, and a thread pressing part 7. The thread holding base member 4 is formed of a thread holding plate 41, and coupling arm-shaped parts 42 that are formed at both upper and lower ends of the thread holding plate 41. Both the coupling arm-shaped parts 42 are formed with coupling holes 42*a* through which the needle threading shaft 21 are pierced. The needle threading shaft 21 is inserted into and is also fixed in an axial peripheral direction to the coupling arm-shaped parts 42.

A pivot pin 45 is formed on the upper coupling arm-shaped part 42 (see FIGS. 2B and 2C). The pivot pin 45 is present at a position at an opposite side of a position where the thread holding plate 41 is formed, centered around the coupling hole 42*a*. The pivot pin 45 is pivot coupled to the second link member 27.

The thread holding tool A is a member that gives tension to the upper thread N while holding the end part of the upper thread N when performing the needle threading operation (see FIGS. 7A, 70, and 7D). The thread holding plate 41 of the thread holding base member 4 is provided to be positioned at the left side of the needle 9 as observed from the front, when the thread holding tool A is at a waiting position.

The thread holding plate 41 is formed with a holding groove part 43 (see FIGS. 3A and 3B). The holding groove part 43 is a groove that is formed horizontally. The holding groove part 43 has a bottom surface part and an upper surface. The bottom surface becomes a thread holding surface part 44. The thread holding surface part 44 is a portion that becomes a base on which the upper thread N which is inserted into the holding groove part 43 is pressed by a spring plate part 51 described later.

The thread holding plate 41 having the holding groove part 43 has a sufficient thickness to sandwich the upper thread N, together with the spring plate part 51. On one end side in the horizontal direction of the holding groove part 43, there is formed a guide introduction entrance 43*a* having an opening into which the upper thread N is introduced (see FIGS. 3A and 3B). A direction of the opening of the holding groove part 43 is not limited to the horizontal direction as mentioned above.

The guide introduction entrance 43*a* is formed so that a vertical width is gradually smaller from the opening toward the end terminal side of the holding groove part 43, and is formed in approximately a V shape in a lateral direction. The upper thread N is sandwiched by the thread holding base member 4, by being inserted by sliding into the holding groove part 43.

The thread pressing member 5 is configured by the spring plate part 51 and a cover mounting part 52. The thread pressing member 5 is a member that is mounted with the cover mounting part 52 so that the cover mounting part 52 covers the thread holding plate 41 of the thread holding base member 4.

The spring plate part 51 is brought into contact with the upper surface of the thread holding surface part 44 of the holding groove part 43, in a state that the thread pressing member 5 is mounted on the thread holding base member 4 (see FIGS. 3C and 3D). The spring plate part 51 is formed in an inclined shape from the upper surface side of the guide introduction entrance 43*a* of the holding groove part 43 toward the thread holding surface part 44. Specifically, the spring plate part 51 is configured by an inclined plate part 51*a* and a pressing plate part 51*b*. The pressing plate part 51*b* is formed as a flat surface, and is for pressing the upper thread N to the thread holding surface part 44.

Figure 4A:
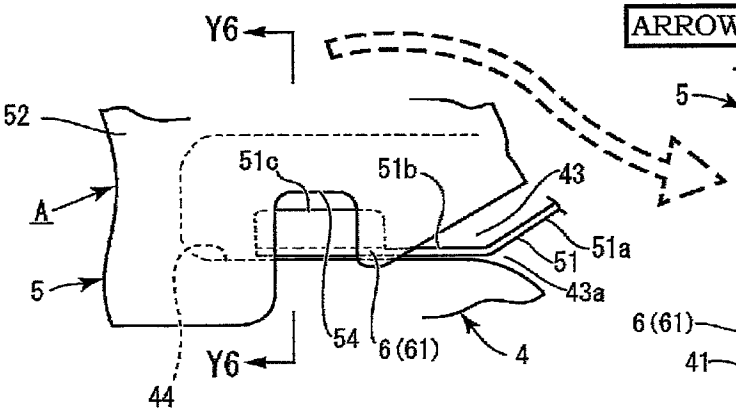
FIG. 4A is an enlarged view of a main part of a first type of a thread detachment preventing part according to a modification of the first embodiment of the present invention.
Figure 4D:
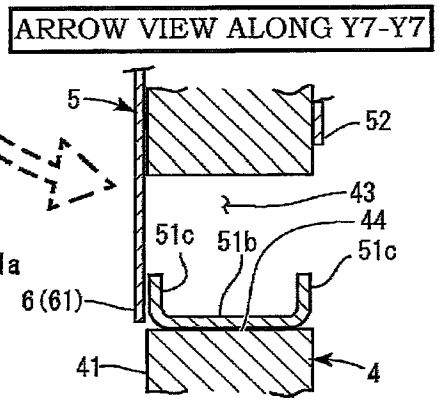
FIG. 4D is an arrow view along Y7-Y7 in FIG. 4C.

The pressing plate part 51*b* in a width direction is formed in the same size as or slightly smaller than the thickness of the thread holding plate 41 having the holding groove part 43 (see FIG. 3D, FIGS. 4B and 4D, etc.). The width direction of the pressing plate part 51*b* is a direction that is the same as a thickness direction of the thread holding plate 41, in a state that the spring plate part 51 is mounted on the thread holding plate 41.

A rising piece 51*c* is sometimes formed on at least one end in the width direction of the pressing plate part 51*b* (see FIGS. 3B and 3D). The rising piece 51*c* is sometimes formed at both ends in the width direction of the pressing plate part 51*b*. The rising piece 51*c* is integrally formed by bending from an end edge in the width direction of the pressing plate part 51*b*. It is preferable that the bending portion between the pressing plate part 51*b* and the rising piece 51*c* is formed in approximately an arc shape in the cross section.

Figure 5B:
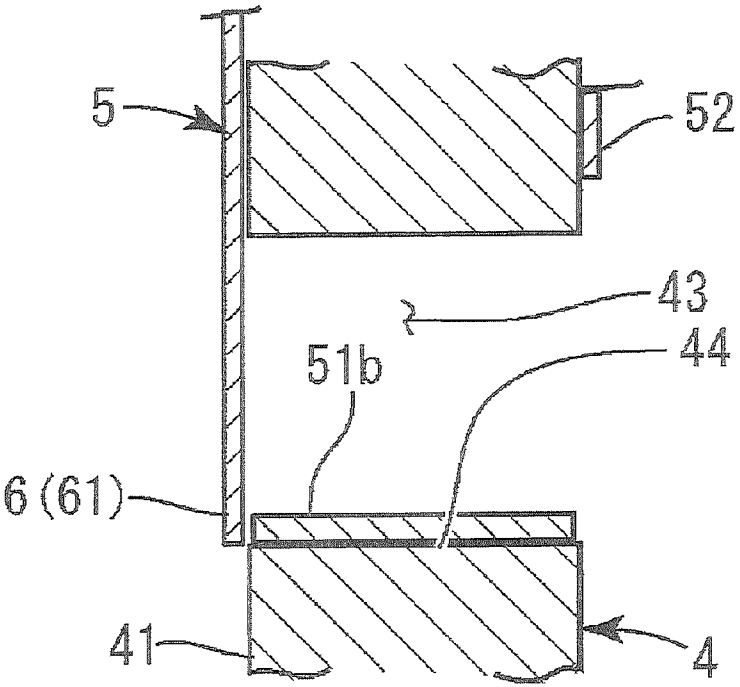
FIG. 5B is a sectional view of a main part of the thread pressing member having a third type of a pressing plate part.
Figure 5A:
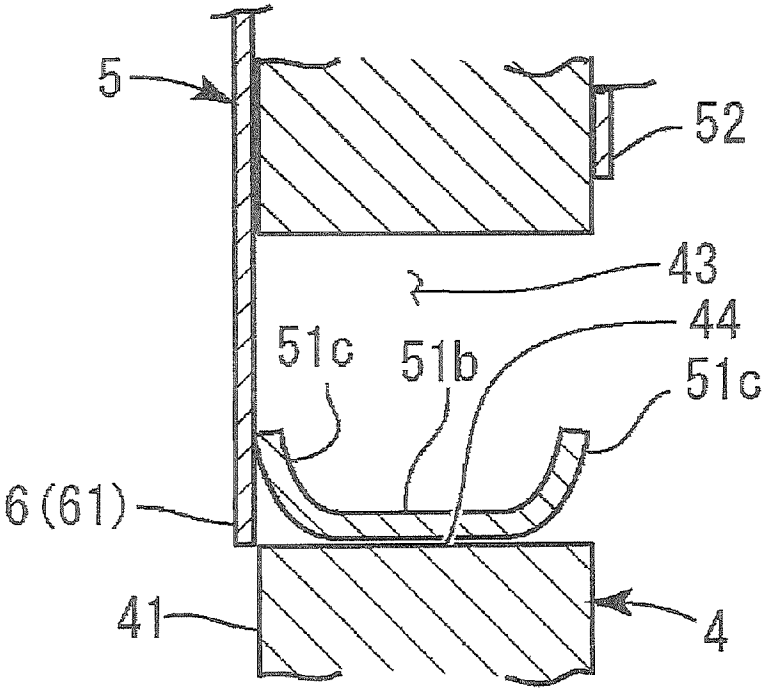
FIG. 5A is a sectional view of a main part of the thread pressing member having a second type of a pressing plate part.

Further, the pressing plate part 51*b* is sometimes formed in approximately a recessed arc shape in the cross section along the width direction (see FIG. 5A). In this way, by forming the rising piece 51*c* on the pressing plate part 51*b* or by forming the pressing plate part 51*b* in an arc shape in the cross section along the width direction of the pressing plate part 51*b*, the upper thread N that passes through the holding groove part 43 can be prevented from being formed with hangnail and fuzz, even when the upper thread N is in a state of being pressed by the spring plate part 51. The pressing plate part 51*b* can be also formed in a simple flat shape without being formed with the rising piece 51*c* (see FIG. 5B).

The thread holding tool A is provided with a thread detachment preventing part 6. The thread detachment preventing part 6 is a portion that is provided in the thread holding tool A in a state of being inserted into the holding groove part 43 and that also crosses the upper thread N which is sandwiched between the thread pressing member 5 and the thread holding surface part 44. The thread detachment preventing part 6 blocks a path to which the upper thread N deviates from the holding groove part 43, in order to prevent the upper thread N inserted into the holding groove part 43 from being easily deviated from the holding groove part 43. The thread detachment preventing part 6 is for also regulating the upper thread N in the holding groove part 43 so that the upper thread N passes to a predetermined direction from the thread holding state. The predetermined direction is a direction in which a hook 81*a* of the needle threading tool 8 is positioned from the holding groove part 43.

There are a plurality of embodiments for the thread detachment preventing part 6. A first embodiment of the thread detachment preventing part 6 is that a projection piece 61 that is protruded from above downward at an outer surface side of the thread holding base member 4 (see FIG. 1C, FIGS. 2A and 2D, FIGS. 3A and 3D, FIGS. 4A to 4D, and FIGS. 5A and 5B, etc.). The lower end of the projection piece 61, that is, the front end, is at the same position as that of the thread holding surface part 44 of the holding groove part 43, and is also set to cross the upper thread N in the holding groove part 43 (see FIG. 3D). The projection piece 61 is a portion that is integrally formed on the thread pressing member 5, and is continuously formed with a part of a front side cover part of the cover mounting part 52.

Figure 6A:
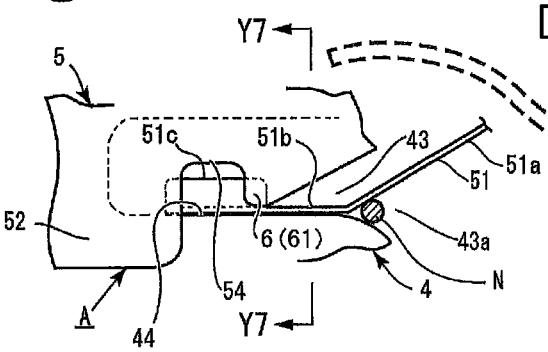
FIG. 6A is an enlarged view of a main part of the thread holding tool in a state that an upper thread is about to be inserted into a guide introduction entrance of a holding groove part.
Figure 6B:
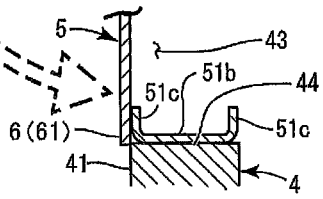
FIG. 6B is an arrow sectional view along Y7-Y7 in FIG. 6A.
Figure 6C:
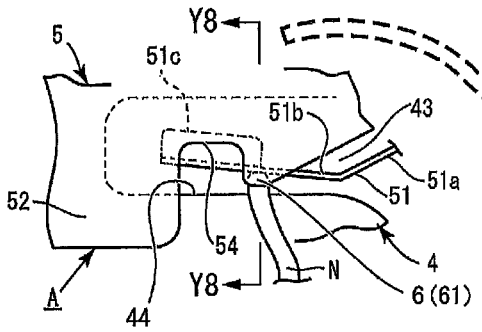
FIG. 6C is an enlarged view of the main part of the thread holding tool in a state that the upper thread is about to exceed a projection piece.
Figure 6D:
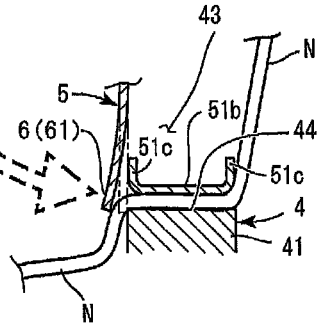
FIG. 6D is an arrow sectional view along Y8-Y8 in FIG. 6C.
Figure 6E:
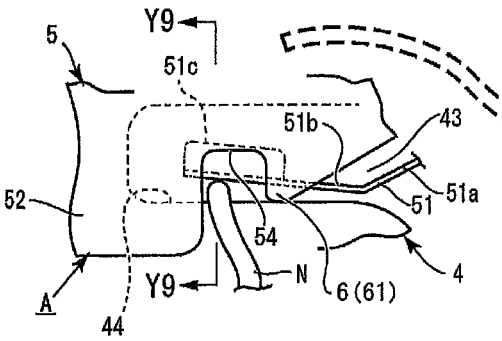
FIG. 6E is an enlarged view of the main part of the thread holding tool in a state that the upper thread has exceeded the projection piece and has been accommodated in a depth side of the holding groove part.
Figure 6F:
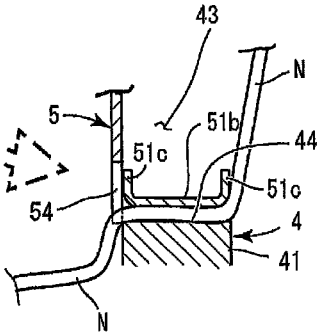
FIG. 6F is an arrow sectional view along Y9-Y9 in FIG. 6E.

The projection piece 61 is formed in approximately an inverted triangular shape, and the inclination angle of the lower piece at a guide introduction entrance 43*a* side is formed small so that the upper thread N that is introduced into the holding groove part 43 can smoothly move. When the upper thread N passes through between the end edge in the width direction of the thread holding surface part 44 of the holding groove part 43 and the projection piece 61, the projection piece 61 is elastically deformed so that the projection piece 61 is peeled outward by the thickness of the upper thread N (see FIGS. 6C and 6D and FIG. 7A).

Although the lower end of the projection piece 61 is set at the same position as the position of the thread holding surface part 44 of the holding groove part 43, as a first type of other modification of the projection piece 61, the front end of the projection piece 6 is sometimes set at a lower position than the position of thread holding surface part 44 (see FIGS. 4A and 4B). In this type, a superposed quantity of the position of the front end of the projection piece 61 and the position of the thread holding surface part 44 is extremely small, and the front end of the projection piece 61 may be at a position where the front end slightly exceeds a position of the thread holding surface part 44. As a second type of the modification, the upper thread N accommodated in an accommodation space part 54 is configured to be able to be least detached from the holding groove part 43.

Figure 4C:
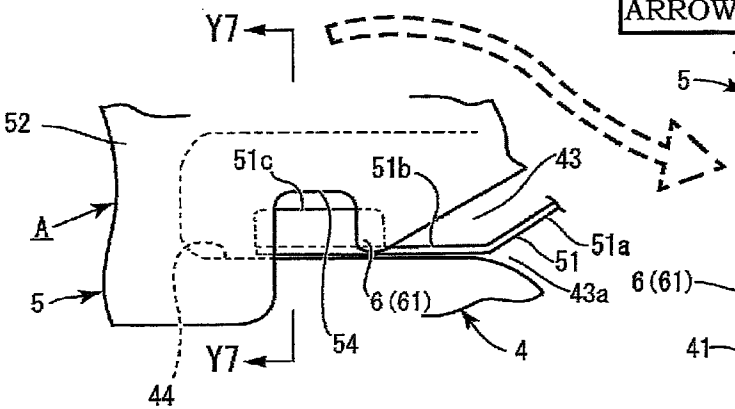
FIG. 4C is an enlarged view of a main part of a second type of a thread detachment preventing part according to a modification of the first embodiment of the present invention.

As the second type of the modification of the projection piece 61, the front end of the projection piece 61 may be configured to be higher than the thread holding surface part 44 (see FIGS. 4C and 4D). However, in the present embodiment, the interval between the front end of the projection piece 61 and the position of the thread holding surface part 44 needs to be smaller than the diameter of the upper thread N. In the present embodiment, when inserting the upper thread N into the holding groove part 43, resistance of the projection piece 61 is the smallest, and the upper thread N can be easily inserted into the accommodation space part 54.

As a second embodiment of the thread detachment preventing part 6, a protrusion part 62 is formed on the thread holding surface part 44, and the protrusion part 62 and the spring plate part 51 of the thread pressing member 5 are configured not to interfere with each other (see FIGS. 8A to 8D).

Specifically, the protrusion part 62 is formed on the portion near the release side on the thread holding surface part 44 which is the bottom surface part of the holding groove part 43. The protrusion part 62 is configured such that the protrusion part 62 and the spring plate part 51 that presses the thread holding surface part 44 do not interfere with each other. That is, the protrusion part 62 and the spring plate part 51 are in a positional relationship that the protrusion part 62 and the spring plate part 51 do not interfere with each other. There are also a plurality of types of this configuration.

Figure 8A:
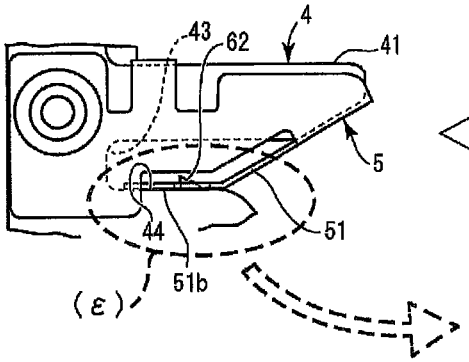
FIG. 8A is a front view of a main part of a first type of a thread detachment preventing part according to the second embodiment of the present invention.
Figure 8B:
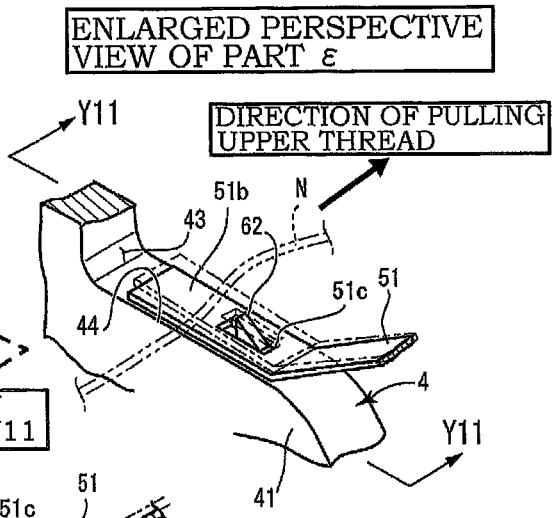
FIG. 8B is an enlarged perspective view of a part 8 in FIG. 8A.
Figure 8C:
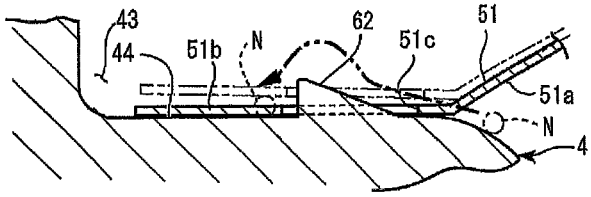
FIG. 8C is an arrow enlarged sectional view along Y11-Y11 in FIG. 8B.

As a first type, the protrusion part 62 is formed in a mountainous shape of approximately a right-angled triangular shape (see FIGS. 8A to 8C). The protrusion part 62 at the release (start) side of the holding groove part 43 has a shape of a mild inclined surface that forms a small inclination angle. A shape of the protrusion part 62 at the depth (terminal end) side of the holding groove part 43 of the protrusion part 62 is a sharp inclination that forms a vertical or rapid inclination angle. Preferably, the crest part of the protrusion part 62 is formed in approximately an arc shape.

That is, when the upper thread N is inserted from the release. (start end) side of the holding groove part 43, the upper thread N can move to the depth side of the holding groove part 43 by overriding the crest part while being brought into contact with the mild inclined surface of the protrusion part 62. Therefore, by the protrusion part 62, the upper thread N is configured to be able to be easily inserted into the holding groove part 43, and is oppositely not easily detached from the holding groove part 43.

An opening hole 51*d* is formed on the pressing plate part 51*b* of the spring plate part 51 that presses the upper thread N on the thread holding surface part 44 from the above. The opening hole 51*d* is at a position where the protrusion part 62 can be inserted when the pressing plate part 51*b* is brought into contact with the thread holding surface part 44 from the above. When the pressing plate part 51*b* is about to be brought into contact with the thread holding surface part 44 from the above, the protrusion part 62 is inserted into the opening hole 51*d* (see FIGS. 8B and 8C). Accordingly, the spring plate part 51 and the protrusion part 62 do not interfere with each other without being in contact with each other.

Consequently, the pressing plate part 51*b* of the spring plate part 51 can be brought into contact with the thread holding surface part 44 from the above, and the upper thread N can be sandwiched by pressing by the pressing plate part 51*b* of the spring plate part 51 onto the thread holding surface part 44. At the same time, the protrusion part 62 that is protruded from the opening hole 51*d* can prevent the upper thread N from being easily detached from the holding groove part 43. Although the protrusion part 62 has a right angled triangular shape, the protrusion part 62 is not limited to have this shape, and can have an arc mountainous shape, a trapezoidal shape, a triangular shape, or a semicircular shape.

Figure 8D:
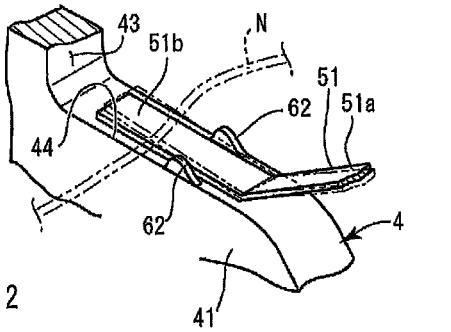
FIG. 8D is a perspective view of a main part of a second type of a thread detachment preventing part according to the second embodiment of the present invention.

Next, as a second type, the protrusion part 62 is formed at both side positions in the width direction (a thickness direction of the thread holding plate 41) of the thread holding surface part 44, and the pressing plate part 51*b* of the spring plate part 51 is configured to be inserted into between both the protrusion parts 62 (see FIG. 8D). The pressing plate part 51*b* of the spring plate part 51 enters between both the protrusion parts 62, and the protrusion parts 62 are not in contact with each other and do not interfere with each other. The protrusion parts 62 have approximately the same shapes as that of the protrusion part 62 of the first type.

Figure 8E:
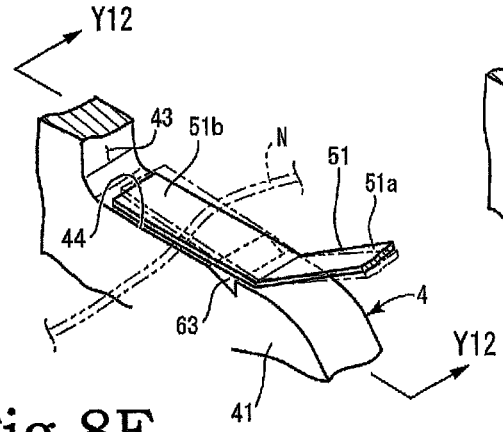
FIG. 8E is a perspective view of a main part of a thread detachment preventing part according to a third embodiment of the present invention.
Figure 8F:
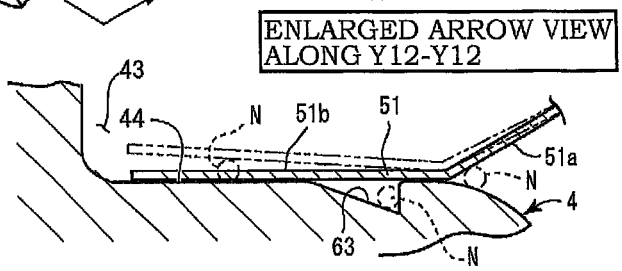
FIG. 8F is an arrow enlarged sectional view along Y12-Y12 in FIG. 8E.

Next, as a third embodiment of the thread detachment preventing part 6, a notched part 63 in a notch or groove shape is formed on the thread holding surface part 44 (see FIGS. 8E and 8F). The notched part 63 is a groove in approximately a flat V shape or a right angled triangular shape in the cross section, and is formed along the width direction (a thickness direction of the thread holding plate 41) of the thread holding surface part 44.

Specifically, the notched part 63 is formed in a vertical shape at the opening side of the holding groove part 43, and is formed in a mild inclined surface toward the terminal end side of the holding groove part 43. The upper thread N is sandwiched by pressing by the pressing plate part 51*b* of the spring plate part 51 onto the thread holding surface part 44. However, when the upper thread N moves to the opening side of the holding groove part 43, the upper thread N can be also accommodated in the notched part 63, and can be prevented from being detached from the holding groove part 43.

The thread pressing part 7 is a member that is brought into contact with the upper thread N which is applied between the thread hooking part 14 and the thread holding base member 4. The thread pressing part 7 guides the upper thread N to be positioned on a proper path, by being brought into contact with the upper thread N. At the same time, by tensioning the upper thread N by fixing the end part of the upper thread N by the thread pressing member 5, the thread pressing part 7 arranges the tensioned upper thread N to a front surface side of the needle hole 9*a* of the needle 9 (see FIGS. 7A, 7C, and 7D).

That is, when the thread holding tool A and the needle threading tool 8 move from the waiting position to the needle threading position, the thread pressing part 7 is brought into contact with the upper thread N so as to hook the upper thread N. Consequently, the upper thread N is guided to be positioned at the front surface side of the needle hole 9*a* of the needle 9.

Based on the thread pressing part 7 being brought into contact with the upper thread N, the upper thread N is tensioned to become in approximately a straight line in front of the needle hole 9*a*. The thread pressing part 7 is provided to hold a predetermined relationship with the thread holding base member 4.

On the thread pressing part 7, there is formed a pressing claw 71 that is extended in a horizontal direction from the end part of the surface which is brought into contact with the upper thread N. The pressing claw 71 is a member that is first brought into contact with the upper thread N when the thread holding base member 4 is lowered from the thread hooking part 14. The lower surface of the pressing claw 71 is formed to become a surface inclined downward to the front end.

The needle threading tool 8 is a member for passing the upper thread N, which is applied between the thread hooking part 14 and the thread holding base member 4, through the needle hole 9*a* of the needle 9. The needle threading tool 8 and the thread holding tool A are provided oppositely via the needle threading shaft 21. As described below, the needle threading tool 8 is configured to be able to pass the upper thread N through the needle hole 9*a*, by arranging such that the thread holding tool A enters the needle hole 9*a* from the rear surface of the needle 9, hooks the upper thread N which is held in front of the needle 9, and thereafter, recedes.

The needle threading tool 8 is formed of a hook plate 81, and two needle threading guide plates 82, as shown in FIG. 1G. The hook plate 81 is fitted to a holder 83 while being sandwiched between the needle threading guide plates 82. A hook 81*a* is a member that is formed on a front end of the hook plate 81, and that is inserted loosely into the needle hole 9*a* from a rear surface side of the needle 9. The hook 81*a* hooks the upper thread N which is set in the tensioned state at the front surface side of the needle by the thread holding tool A, and the hook 81*a* passes the upper thread N through the needle hole 9*a*.

A turning hole 83*a* is formed on the holder 83. The needle threading shaft 21 pierces through the turning hole 83*a*. The holder 83 is configured to be positioned at this time between the coupling arm-shaped parts 42 of the thread holding base member 4 that is similarly mounted on the needle threading shaft 21. The needle threading tool 8 turns in the axial peripheral direction of the needle threading shaft 21 by the guide member 25, the first link member 26, and the second link member 27.

Next, the needle threading operation by the needle threading device will be described. First, the upper thread N is pulled out from the supply source of the upper thread N, and the upper thread N is passed through the thread hooking part 14. The end part of the upper thread N is inserted into the holding groove part 43 of the thread holding base member 4 while bringing the thread pressing part 7 of the thread holding tool A into contact with the upper thread N. At this time, the end part of the upper thread N moves to the accommodation space part 54 by exceeding the projection piece 61 (see FIGS. 6A to 6F). The end part of the upper thread N is fixed in the holding groove part 43 by the spring plate part 51 of the thread pressing member 5.

The motor of the motor driving unit is driven, and the needle threading shaft 21 and the guide shaft 22 move downward. The thread holding tool A and the needle threading tool 8 move downward together with the needle threading shaft 21 and the guide shaft 22 from a stand-by position. When the thread holding tool A has started to fall, the lower surface of the pressing claw 71 of the thread pressing part 7 that is positioned between the thread hooking part 14 and the thread holding base member 4 is brought into contact with the upper thread N that is applied between the thread hooking part 14 and the thread holding base member 4.

The upper thread N that is applied between the thread hooking part 14 and the thread holding base member 4 is tensioned by the thread pressing part 7 (see FIG. 7A). When the thread pressing part 7 has been provided lower than the thread holding position of the thread holding base member 4, the upper thread N is tensioned stronger than when the thread pressing part 7 has been provided at the same height as that of the thread holding position. Because the front end portion of the pressing claw 71 is inclined to a lower side, the upper thread N is not detached from the thread pressing part 7, and is guided to a root side of the pressing claw 71 as the thread pressing position.

The motor driving unit lowers the thread holding tool A and the needle threading tool 8 to a position where the thread is to be passed to the needle hole 9*a* of the needle 9. In the thread holding tool A that has been lowered to the needle threading position, the upper thread N which is applied between the thread hooking part 14 and the thread holding base member 4 is guided to be positioned via the space in the front surface of the needle hole 9*a* of the needle 9 by the thread pressing part 7. Further, the upper thread N is tensed in approximately a straight line shape on the front surface of the needle hole 9*a* by the thread pressing part 7, and can hold a sufficient tensioned state for the needle threading operation (see FIGS. 7A, 7C, and 7D).

The motor driving unit continues the driving without any modification so that the front end of the hook plate 81 of the needle threading tool 8 pierces through the needle hole 9*a*. When the hook 81*a* implements lock on the tensioned upper thread N, the hook 81*a* is extracted from the needle hole 9*a*, and the upper thread N can be passed through the needle hole 9*a* of the needle 9 (see FIGS. 7B and 7C).

The present invention can be applied to various sewing machines such as a lock stitch sewing machine and a multineedle sewing machine, and can be applied to a conventional sewing machine and a sewing machine that can be used in future.

In the second implementation mode, the thread holding tool includes a thread holding base member, and a thread pressing member that is mounted on the thread holding base member. A holding groove part in a groove shape is formed along a horizontal direction on the thread holding plate of the thread holding base member. On the thread pressing member, there are formed a spring plate part that presses the thread against the thread holding surface part of the holding groove part, and a protrusion piece that is protruded from above downward at the front surface side of the thread holding plate.

The upper thread supplied from the supply source of the upper thread of the sewing machine passes through the thread hooking part which is provided near the needle stopper on the needle bar. The upper thread is fixed in a state of being sandwiched between the spring plate part and the thread holding surface part of the holding groove part, by only having the end part of the upper thread inserted into the holding groove part of the thread holding plate from the horizontal direction. Further, when inserting the end part of the upper thread into the holding groove part, the projection piece can prevent the upper thread, that has passed through the projection piece and entered near the end part of the holding groove part, from being easily detached from the holding groove part.

As described above, the thread holding tool can be extremely simply operated by only inserting the upper thread into the holding groove part in order to give tension to the upper thread, and can be configured to be able to prevent the tensioned upper thread from being easily extracted from the thread holding tool, and also be able to easily extract the upper thread N from the thread holding tool, after completing the needle threading operation.

In the third implementation mode, the front end of the projection piece of the thread pressing member is set at the same position as the position of the thread holding surface part. Therefore, the upper thread N can be extremely simply inserted into and extracted from the thread holding tool. In the fourth implementation mode, the front end of the projection piece of the thread pressing member is set at a lower position than the position of the thread holding surface part. Therefore, the upper thread N cannot be easily extracted from the thread holding tool. In the fifth implementation mode, the front end of the projection piece of the thread pressing member is set at a higher position than the position of the thread holding surface part. Therefore, the upper thread N can be easily extracted from the thread holding tool.

In the sixth and seventh implementation modes, equivalent effects of the first and second implementation modes can be obtained. In the eighth implementation mode, the rising piece is formed on at least one end in the width direction of the pressing plate part of the thread pressing member. In the ninth implementation mode, the bottom part of the pressing plate part of the thread pressing member is formed in an arc shape, thereby preventing forming hangnail and fuzz in the thread N.

What is claimed is:

1. A sewing machine equipped with a needle threading device, comprising:

a needle bar supporting frame body on which there is mounted a needle bar that is mounted with a needle having a needle hole;

a needle threading shaft that is disposed on the needle bar supporting frame body and is supported vertically movably and also turnably in a peripheral direction;

a thread pressing part and a thread holding tool that are provided at a lower end of the needle threading shaft and that hold in a tensioned state a thread opposite the needle hole; and a needle threading tool that is provided at a lower end of the needle threading shaft and that has a hook which reciprocates through the needle hole to pass the thread through the needle hole, wherein the thread holding tool comprises:

a thread holding surface part that guides and holds the thread;

a thread pressing member that presses and sandwiches together with the thread holding surface part the thread;

a thread detachment preventing part, the thread being sandwhiched between the thread pressing member and the thread holding surface part; and a thread holding plate that holds the thread which is fixed to the needle threading,shaft, and wherein the, thread pressing member comprises a spring plate part that comprises a projection piece for preventing a thread detachment.

2. The sewing machine equipped with a needle threading device acorrding to claim 1, wherein the thread holding tool further comprises a thread holding base member equipped with the thread holding plate, and the thread pressing member that is mounted on the thread holding base member and that holds the thread by pressing, and wherein the thread holding plate forms a holding groove part that has an end surface of a groove, of which one end is opened, as a thread holding surface part which holds the thread, wherein the spring plate part sandwiches together with the thread holding surface part the thread by pressing, and wherein the projection piece is provided to cross the thread that is held by pressing by the holding groove part of the thread holding plate.

3. The sewing machine equipped with a needle threading device according to claim 2, wherein a front end of the projection piece is at the same position as a position of the thread holding surface part.

4. The sewing machine equipped with a needle threading device according to claim 2, wherein a front end of the projection piece is at a lower position than a position of the thread holding surface part.

5. The sewing machine equipped with a needle threading device according to claim 2, wherein a front end of the projection piece is at a higher position than a position of the thread holding surface part.

6. The sewing machine equipped with a needle threading device according to claim 2, wherein a rising piece is formed on at least one end in a width direction of a pressing plate part of the thread pressing member.

7. The sewing machine equipped with a needle threading device according to claim 2, wherein a bottom part of a pressing plate part of the thread pressing member is formed in an arc shape.

8. The sewing machine equipped with a needle threading device according to claim 1, wherein a rising piece is formed on at least one end in a width direction of a pressing plate part of the thread pressing member.

9. The sewing machine equipped with a needle threading device according to claim 1, wherein a bottom part of a pressing plate part of the thread pressing member is formed in an arc shape.

10. A sewing machine equipped with a needle threading device, comprising:

a needle bar supporting frame body on which there is mounted a needle bar that is mounted with a needle having a needle hole;

a needle threading shaft that is disposed on the needle bar supporting frame body and is supported vertically movably and also turnably in a peripheral direction;

a thread pressing part and a thread holding tool that are provided at a lower end of the needle threading shaft and that hold in a tensioned state a thread opposite the needle hole; and a needle threading tool that is provided at a lower end of the needle threading shaft and that has a hook which reciprocates through the needle hole to pass the thread through the needle hole, wherein the thread holding tool comprises a thread holding surface part that guides and holds the thread, a thread pressing member that presses and sandwhiches together with the thread holding surface part the thread, and a thread detachment preventing part, the thread being sandwhiched between the thread pressing member and the thread holding surface part, wherein, when passing the thread through the needle hole, the thread detachment preventing part regulates the thread so that the thread, which is sandwiched between the thread holding surface part and the thread pressing member of the thread holding tool, passes in a predetermined direction without deviating from a thread holding state, wherein the thread holding tool further comprises a thread holding base member equipped with a thread holding plate that holds the thread which is fixed to the needle threading shaft, and the thread pressing member that is mounted on the thread holding base member and that holds the thread by pressing, wherein the thread holding plate forms a holding groove part has an end surface of a groove, of which one end is opend, as a thread holding surface part which holds the thread, wherein the thread pressing member comprises a spring plate part that sandwhiches together with the thread holding surface part the thread by pressing , and also comprises a projection piece for preventing thread detachment, and wherein the projection piece is provided to cross the thread that is held by pressing by the holding groove part of the thread holding plate.

11. The sewing machine equipped with a needle threading device according to claim 10, wherein a rising piece is formed on at least one end in a width direction of a pressing plate part of the thread pressing member.

12. The sewing machine equipped with a needle threading device according to claim 10, wherein a front end of the projection piece is at a lower position than a position of the thread holding surface part.

* * * * *